US006360727B1

(12) United States Patent
DeLuca

(10) Patent No.: US 6,360,727 B1
(45) Date of Patent: Mar. 26, 2002

(54) REDUCE INITIAL FEED RATE INJECTOR WITH FUEL STORAGE CHAMBER

(75) Inventor: Frank DeLuca, Enfield, CT (US)

(73) Assignee: Alfred J. Buescher, Shaker Heights, OH (US)

( * ) Notice: Subject to any disclaimer, the term of this patent is extended or adjusted under 35 U.S.C. 154(b) by 0 days.

(21) Appl. No.: 09/524,810

(22) Filed: Mar. 14, 2000

(51) Int. Cl.[7] ..... F02M 37/04

(52) U.S. Cl. ..... 123/496; 123/447

(58) Field of Search ..... 123/447, 496, 123/506, 300, 299, 446

(56) References Cited

U.S. PATENT DOCUMENTS

| | | | | |
|---|---|---|---|---|
| 1,735,718 | A | 11/1929 | Attendu | 123/447 |
| 2,070,932 | A | 2/1937 | Taylor | 123/447 |
| 2,380,148 | A | 7/1945 | Camner | 123/447 |
| 2,513,883 | A | 7/1950 | Male | 123/447 |
| 2,558,148 | A | 6/1951 | Nicolls | 123/447 |
| 2,591,401 | A | 4/1952 | Camner | 123/447 |
| 2,625,435 | A | 1/1953 | Larborn | 239/533 |
| 3,342,422 | A | 9/1967 | Millington et al. | 239/533 |
| 3,392,715 | A | 7/1968 | Thoma | 123/139 |
| 3,438,359 | A | 4/1969 | Thoma | 123/32 |
| 3,456,884 | A | 7/1969 | Knight et al. | 239/533 |
| 3,669,360 | A | 6/1972 | Knight | 239/533 |
| 3,747,857 | A | 7/1973 | Fenne | 239/90 |
| 3,810,453 | A | 5/1974 | Wolfe | 123/447 |
| 3,817,456 | A | 6/1974 | Schlappkohl | 239/533 |
| 3,961,612 | A | 6/1976 | Okamoto et al. | 123/139 |
| 4,029,071 | A | 6/1977 | Saito et al. | 123/139 |
| 4,096,999 | A | 6/1978 | Eckert et al. | 239/533.5 |
| 4,165,838 | A | 8/1979 | Nakayama et al. | 239/533.3 |
| 4,229,148 | A | 10/1980 | Richmond et al. | 417/485 |

(List continued on next page.)

FOREIGN PATENT DOCUMENTS

| | | |
|---|---|---|
| GB | 634030 | 4/1950 |
| GB | 636098 | 5/1950 |

OTHER PUBLICATIONS

K.P. Mayer, "Fuel economy, emissions and noise of multi-spray light duty DI diesels—current status and development trends", 1984, SAE Paper No. 841288, 10 Pages.

Document bearing legends "AVL, Graz–Austria", "Scheme Of Split Injection Device (SID)", "T.R. 736, Fig. 21", Note: This document is believed to have constituted part of Technical Report No. 736, AVL List Ges mbH, Graz, Austria, circa 1984. The device illustrated in this document is believed to be substantially the same as that shown in above–cited U.S. Pat. 4,681,080 to Bruno Schukoff of Graz, Austria, but is cited in the interest of completeness. Applicant has not located a copy of said Technical Report No. 736.

*Primary Examiner*—Henry C. Yuen
*Assistant Examiner*—Mahmoud Gimie
(74) *Attorney, Agent, or Firm*—Pearne & Gordon LLP

(57) ABSTRACT

A diesel injector is provided with a variable-volume flow-subtraction chamber containing a spring-loaded flow-subtraction piston. The chamber is connected to the pump chamber or related lines by passages that include a flow-subtraction control orifice. A space behind the piston is vented to fuel supply ducting that is associated with the system. A flow-subtraction control orifice controls the subtractive flow of fluid into the flow-subtraction chamber in predefined proportion to the flow of fluid through the combined nozzle orifices, such proportion being that between the cross-sectional area of the control orifice and the combined cross-sectional areas of the nozzle orifices. Such proportion of flow is maintained until the subtractive flow ends as the piston reaches a stop at its fully open position, whereupon the reduced-rate-of-injection phase ends and the main injection phase then occurs. During each cycle of operation, injection is monolithic or continuous throughout reduced-rate-of-injection and main injection phases, and at varying engine loads and speeds.

12 Claims, 5 Drawing Sheets

U.S. PATENT DOCUMENTS

| | | | | |
|---|---|---|---|---|
| 4,367,706 | A | 1/1983 | Scheying | 123/300 |
| 4,392,612 | A | 7/1983 | Deckard et al. | |
| 4,425,894 | A | 1/1984 | Kato et al. | 123/446 |
| 4,513,916 | A | 4/1985 | Skinner | 239/453 |
| 4,544,097 | A | 10/1985 | Aoki et al. | 123/126 |
| 4,566,635 | A | 1/1986 | Trachte | 239/533.8 |
| 4,681,080 | A | 7/1987 | Schukoff | 123/506 |
| 4,718,384 | A | 1/1988 | Takahashi | 123/447 |
| 4,741,314 | A | 5/1988 | Hofer | 123/449 |
| 4,811,715 | A | 3/1989 | Djordjevic et al. | 123/447 |
| 5,156,132 | A | 10/1992 | Iwanaga | 123/496 |
| 5,205,326 | A | 4/1993 | Paley et al. | 138/30 |
| 5,381,772 | A | 1/1995 | Melchior et al. | 123/447 |
| 5,533,672 | A | 7/1996 | Peters | 239/88 |
| 5,673,669 | A | 10/1997 | Maley et al. | 123/446 |
| 5,743,237 | A | 4/1998 | Matta | 123/496 |
| 5,870,996 | A | 2/1999 | DeLuca | 123/496 |
| 6,009,850 | A | 1/2000 | DeLuca | 123/299 |

REDUCE INITIAL FEED RATE INJECTOR WITH FUEL STORAGE CHAMBER

FIELD OF THE INVENTION

This invention relates to diesel fuel injectors and fuel injection pumps. The invention is applicable to unit injectors used on locomotive, automotive, marine and stationary engines, in which the pump, nozzle and holder assembly are a single unit. The invention is also applicable to injection systems in which the fuel is fed from the pump through tubing to a separate nozzle-and-holder assembly.

BACKGROUND

A known type of fuel injector for diesel engines comprises a fuel pump and an injection nozzle associated with the fuel pump. The fuel pump includes a pump cylinder and a pump plunger reciprocatable in the cylinder. The cylinder and plunger together define a pump chamber open at one end for the discharge of fuel during a pump stroke and for fuel intake during a suction stroke of the plunger. The injection nozzle is associated with a valve body having a spray outlet at one end for the discharge of fuel at the nozzle tip. The nozzle valve is movable in the nozzle body between open and closed positions to control flow through the spray outlet. The valve is spring-biased to closed position and openable when such discharge of fuel during a pump stroke reaches a given level of pressure. The valve then remains open until pressure drops to a closing pressure somewhat below the opening pressure. The closing pressure is below the opening pressure because the valve face area subject to opening pressures is somewhat greater when the valve is open and unseated than when it is closed and seated.

Fuel is supplied to the pump and excess fuel is returned from the pump to reservoir through low pressure passages communicating with the pump chamber. The low pressure passages constitute fill and spill passages. The inlet port area is large enough to fill the pump chamber under the highest engine operating speeds. The flow area of the spill port is large enough that the fuel is spilled back into the fuel supply ducting of the low pressure supply system (or into the return to reservoir, which for present purposes counts as part of the fuel supply ducting) at a rate high enough to prevent the discharge of fuel, resulting from the pump stroke, from reaching the given pressure at which the nozzle valve opens to commence fuel injection, or from remaining above the somewhat lower given pressure at which the open injection valve closes. The ports close and then open during each stroke of the pump plunger to thereby establish, between the closing and opening, the portion of the pump stroke during which such discharge of fuel occurs at pressures above the closing pressure of the injection nozzle.

In purely mechanical injectors, the spill referred to is wholly mechanical, generally in the form of edges and cut-outs formed on the pump plunger which interact with ports opening into the pump bore from the low pressure passages. In other injectors, the spill valving is controlled by a solenoid which opens and shuts a spill passage valve.

Fuel injection, that is, delivery of fuel to the injection nozzle downstream of the plunger chamber at a high enough pressure to cause the nozzle valve to open, occurs during that part of the pump stroke during which the spill passages are closed.

The initial rate of fuel injection has a profound influence on the maximum combustion pressure and temperature generated in a diesel engine combustion chamber during engine operation. When combustion pressure and temperature are elevated above certain limits, nitrogen is oxidized to form nitrous oxide. Ignition delay is the principal reason for generation of such excessively high pressure and temperature. Improved ignition quality of fuel and higher compression pressures can reduce the ignition delay period, but there is a limit to the improvement that can be achieved with improved fuel quality which also carries a cost penalty. Higher compression pressures also have the adverse effect of increasing maximum combustion pressure which in turn tends to increase the formation of nitrous oxide.

Various proposals have been made to deliver injected fuel at a lower rate during the early part of the injection portion of the pump stroke corresponding to the ignition delay period. For example, it has been attempted to deliver fuel at an initially reduced rate by using a two stage lift-cam whereby the initial portion of the cam lift is limited to produce a fixed quantity of fuel delivery by the plunger and then the cam lift ceases for a small period, or slows down, and then resumes its lift at the normal rapid rate to complete the plunger stroke. This two-stage lift method has not been successful because the initial pressure wave generated at port closing is a function of engine speed and injection is inconsistent in the low and intermediate engine speed ranges.

Another previous method has used a separate small plunger to inject a small pilot quantity of fuel preceding the delivery by the main plunger of the main quantity of fuel required by the engine to develop the power required. This is a mechanically complicated and relatively costly system and has not been successful.

It has also been known in the prior art to provide auxiliary spill porting for a reduced rate of fuel feed in the early part of the injection portion of the plunger stroke, but such arrangements were intended to minimize initial injection pressure and were not successful. An example is seen in U.S. Pat. No. 2,513,883 to J. F. Male. It has also been known to use auxiliary spill porting arrangements effective at varying proportions of the injection portion of the feed stroke, as for example in U.S. Pat. No. 4,741,314 to Hofer in which auxiliary porting is arranged so there is a declining duration of leakage as the engine load increases in a straight line relationship with load such that maximum duration of leakage is at idle and there is zero duration of leakage at full load.

Other spill porting systems have been proposed as for example in my U.S. Pat. Nos. 5,870,996 and 6,009,850. These systems are effective, but may be too costly or difficult to fabricate in smaller injector sizes.

Another alternative proposed in the prior art is subtract-then-add-back porting, wherein instead of spilling some of the fuel during the injection portion of the plunger stroke, a portion of the fuel is temporarily diverted from the pump chamber to a fuel subtraction chamber and then during the return stroke of the plunger is returned (added back) from the subtraction chamber to or toward the pump chamber. An example is seen in U.S. Pat. No. 4,811,715 to Djordjevic et al. in which the volume of the fuel subtraction chamber 134 expands and contracts as the pin 128 is forced up into the accumulator chamber 136 and back down again by varying pressures according to the load and speed conditions of the injection pump. However, in this patent, the subtracted fuel is not contained entirely in the subtraction chamber, but in very small part leaks back and forth past the pin 128 into and out of the accumulator chamber 136. Fuel can start to be subtracted from the system before injection begins because the pressure in the accumulator chamber can drop below the nozzle opening pressure during the residual pressure phase of the injection cycle (which is much longer in duration than the injection phase), depending upon the clearance between the plunger and its guide. Also, the condition can vary from injector to injector depending upon the respective clearances of the plungers in the injectors.

British Patent 634,030 also shows a form of subtract-then-add-back porting. Although the patent does not describe itself in those terms, it does contain a fuel subtraction chamber m (not denominated as such) to which a portion of the fuel is diverted as the pump stroke begins and from which the diverted fuel is returned (added back) during the return stroke of the pump. However, the operation of the disclosed device is necessarily such that injection is interrupted and then resumed during the pump stroke (although interruption is not mentioned in the patent description). Such interruption is in part due to lack of constraint on flow into the chamber m as it fills. (Passage n is unrestricted by any control orifice, and the cross-sectional areas of the passages n and g are of comparable size, assuring that as the chamber m rapidly fills and until plunger k reaches the limit of its travel, flow into the chamber m will be at a rate not substantially less than the flow rate through the nozzle orifices c that obtained prior to filling of chamber m, thus abruptly dropping pressure in nozzle chamber e so that the spring i closes the nozzle valve to interrupt injection until such time as plunger k reaches the limit of its travel.)

U.S. Pat. No. 4,681,080 to Schukoff also shows a form of subtract-then-add-back porting. Schukoff's arrangement is very similar to that of the above-discussed British patent. Schukoff explicitly describes how injection is interrupted and then resumed during the pump stroke.

Another example of subtract-then-add-back porting is shown in K. P. Mayer's SAE Paper No.841288, 1984. The device shown in FIG. 3 of Mayer includes a piston within the fuel subtraction chamber formed in the bore of Mayer's "barrel" member. After referring to and describing the device shown in his FIG. 3 as a "split injection device" wherein there is a separation between initial and main injection, Mayer says that "[a]t medium and high engine speeds it is necessary to avoid a separation between the initial and the main injection because of the resulting increase in smoke. At these operating conditions the split injection device is therefore adjusted to only briefly slow down the initial rate of fuel discharge as shown in FIG. 4." However, how such adjustment is made is neither described nor apparent. Nor is it apparent how, if such adjustment is somehow made, the split injection device is then capable of being readjusted to perform as a split injection device at operating conditions not requiring separation between initial and main injection.

As indicated in Mayer, split injection—initial (pilot) injection at a reduced rate followed by a brief interruption and then main injection—has been associated with an increase in smoke under full or high load conditions. Conversely, monolithic injection—a reduced-rate-of-injection phase followed without interruption by a main injection phase—has been associated with reduction of overall emissions. An important object of the present invention is to provide improved monolithic injection under varying loads and operating speeds of the injection system.

BRIEF DESCRIPTION OF THE INVENTION

The present invention provides subtract-then-add-back porting from the pump chamber through a flow-subtraction control orifice to a subtraction chamber in which flow into the subtraction chamber is governed by a control orifice of fixed cross-sectional area bearing a predetermined ratio to the total cross-sectional area of the injection nozzle orifices such that monolithic injection occurs at both low and high load conditions at all operating speeds.

During injection, the flow-subtraction piston is moved from a minimum-volume position to a maximum-volume position so as to contain, on the front or face side of the piston, all subtracted fuel fed into the subtraction chamber. A passageway is connected to the fuel supply ducting of the injector's low-pressure fuel supply system and opens into the space behind the piston to provide for dumping fuel that is behind the piston during filling of the subtraction chamber on the face side of the piston. Significantly, the minimum cross-section of this passageway is sufficient to also allow inlet pressure in the fuel supply ducting to help the piston spring return the piston to its minimum-volume position and thereby help return (add back) the subtracted fuel to or toward the pump chamber during the return stroke of the pump.

The minimum-volume position of the flow-subtraction piston is also a closed or seated position characterized by a relatively high opening-pressure requirement. The intermediate positions of the flow-subtraction piston are unseated positions characterized by relatively lower translating-pressure requirements. Thus, during each pump stroke subtractive flow through the flow-subtraction control orifice is delayed until the relatively high opening-pressure requirement is met. Thereafter the rate of subtractive flow is governed by the cross-sectional area of the flow-subtraction control orifice and the injection pressure prevailing at the area of the control orifice. Subtractive flow continues until the flow-subtraction piston comes up against a fixed stop, and injection at a higher flow rate (due to the termination of subtractive flow) continues immediately thereafter, without any interruption of injection between the reduced-rate-of-injection phase and the main injection phase at a higher rate. Such monolithic injection is maintained at both low and high load conditions.

The result is monolithic or continuous injection during both reduced-rate-of-injection and main injection phases, precise timing of the initiation of subtractive flow relative to the initiation of injection, precise proportioning between subtractive flow and flow through the injection nozzle orifices during the interval during which the flow-subtraction piston moves from its minimum volume position to its maximum-volume position, and robust return of subtracted fuel to or toward the pump chamber during the return stroke of the pump plunger, all accomplished under both low and high load conditions and varying speed conditions.

The invention thereby provides improved means to produce monolithic reduced-initial-rate fuel injection by using subtract-then-add-back porting. Part of the fuel delivered by the pump plunger is diverted simultaneously with or immediately following the beginning of fuel injection through the nozzle orifices and continuing during a reduced-rate-of-injection phase which generally corresponds to the engine ignition delay period. In some cases it may be desirable to continue diversion for a brief interval beyond ignition as may be found necessary to optimize combustion and the reduction of nitrous oxide formation during combustion.

The invention will be more readily and fully understood from the following detailed description and the accompanying drawings.

DETAILED DESCRIPTION OF THE DRAWINGS

In the drawings, FIG. 1 is a cross-sectional view, partially broken away, of a unit injector of the mechanically controlled type, of a kind manufactured or formerly manufactured by EMD, modified to embody the invention.

DETAILED DESCRIPTION OF THE INVENTION

Figure 1:
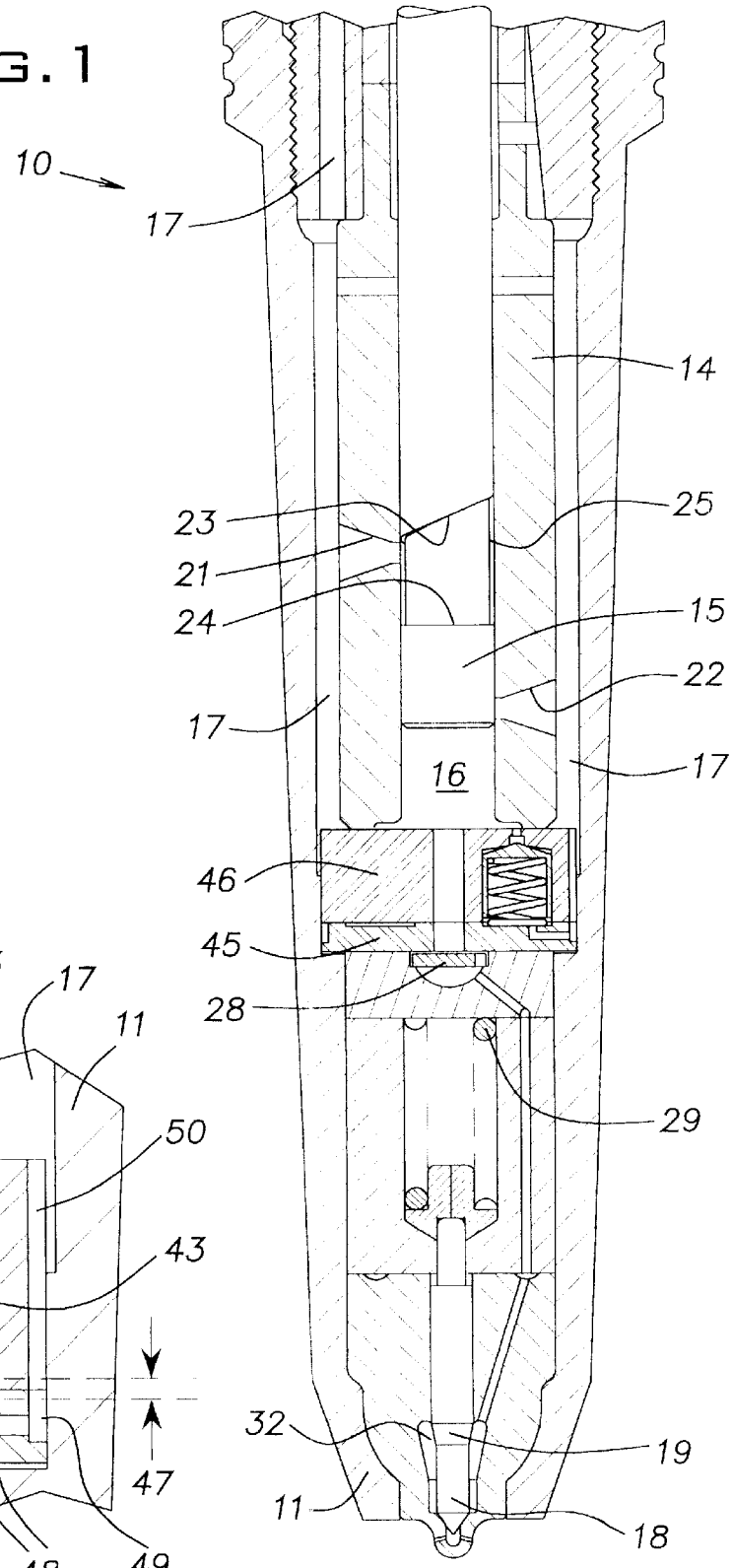

The injector 10 seen in FIG. 1 will be recognized by those familiar with the art as a modified unit injector of the mechanically controlled type manufactured or formerly manufactured by EMD. A typical prior-art EMD unit injector of this type'in unmodified form is shown as injector 10' in FIG. 1 of my U.S. Pat. No. 5,870,996, of common assignee, and is described in some detail in the text of that patent starting at column 6, line 1 and extending to column 7, line 29. Such portions of U.S. Pat. No. 5,870,996 are hereby incorporated by reference as if fully repeated herein, except that in line 12 of column 7 of such patent "one or both of the edges 23' is formed" should be incorporated herein as "one or both of the edges 23' and 24' is/are formed".

In many ways, injector 10 seen in FIG. 1 is similar to the prior-art injector 10' described in U.S. Pat. No. 5,870,996, but injector 10 is modified to embody the present invention. Elements in injector 10 that correspond to the elements of the prior-art injector are labelled with the same reference numbers, but without the primes.

Thus the injector 10 includes an elongated nut or housing 11 corresponding to the elongated nut or housing 11' of injector 10', a pump bushing or sleeve 14 corresponding to the pump bushing 14' of injector 10', a plunger 15 which reciprocates in the bushing 14 and corresponds to the plunger 15', a pump chamber 16 corresponding to the pump chamber 16', and a nozzle valve 18 corresponding to the nozzle valve 18'. The nozzle valve has a given opening pressure and a lower given closing pressure.

Injector 10 includes an injection nozzle body (un-numbered) to which the nozzle valve 18 is fitted, and nozzle orifices (un-numbered) formed in the nozzle tip of the nozzle body. These correspond to similar un-numbered elements of injector 10'. The injector 10 also includes fuel supply ducting 17 for supplying fuel at relatively low pressure to the pump chamber 16. This corresponds to similar ducting (un-numbered) provided in injector 10'.

Injector 10 also includes plunger control edges or helixes 23 and 24 of different helix angles (not excluding a helix angle of zero for one of them, as shown here for edge 24 for simplicity of illustration). The edges 23 and 24 form a relief or recess 25 in the plunger. The pump chamber 16 is ported to this recess through intersecting drilled passageways (not shown), one extending longitudinally up through the lower face of the plunger, and one or more others extending radially inward to the first from the recess 25.

As the plunger 15 moves downward and the plunger helix 23 covers bushing port 21, a pressure wave is generated and travels from the pump chamber 16 past the check valve 28 to the annular cavity or chamber 32 surrounding the lower end of the nozzle valve 18. The nozzle valve remains closed until the first or some succeeding pressure wave raises the pressure to the level of the opening pressure of the nozzle valve 18, at which time the nozzle valve lifts against the force of the spring 29 and injection begins.

As so far described, injector 10 generally corresponds element for element with above-mentioned prior art injector 10'. In accordance with the present invention, injector 10 is also provided with a cylindrical variable-volume flow-subtraction chamber 41 ported to pump chamber 16. The subtraction chamber 41 is formed in an annular piston-housing body 46. A flow-subtraction piston 42 is spring-loaded by the spring 43. Piston 42 is slidably and sealably associated with the flow subtraction chamber 41.

Figure 2:
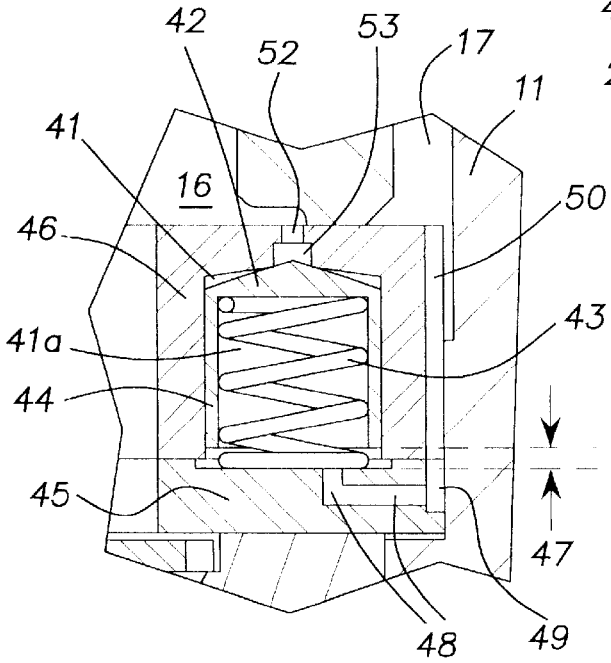
FIG. 2 is a fragmentary view on an enlarged scale of a portion of the structure viewed in FIG. 1.

Piston 42 is moved (displaced) by incoming pressurized fuel from pump chamber 16 from the minimum-volume position illustrated in FIGS. 1 and 2 through intermediate positions to a maximum-volume position at which further movement away from the minimum volume position is stopped, as by engagement of the lower edge of piston skirt 44 with the fixed face in annular spacer 45 against which the lower end of spring 43 engages, as seen most clearly in FIG. 2. In moving from the minimum-volume position to the maximum-volume position, the piston is displaced through distance or stroke 47.

In the embodiment under discussion, such fixed face is inset slightly below the fixed main top face of the annular spacer 45. As shown in FIG. 2, the inset diameter is made slightly larger than the piston diameter so that there will be no interference with the piston outer diameter when it is moving to its stop position. Also, spacer 45 and body 46 are doweled for proper alignment of the displacement piston and the recess in spacer 45.

To avoid the cost of doweling and difficulty in assembling of the parts in an injector, the recess can be formed in spacer 45 in the form of an annular groove, as shown in FIG. 1.

A vent passageway connects to the fuel supply ducting 17 and opens into the space 41a behind the piston 42. In the particular embodiment illustrated in FIGS. 1 and 2, this passageway includes drilled holes 48, annular groove 49, and slot 50. Slot 50 registers with both groove 49 and fuel supply ducting 17 in all possible relative angular positions of elements 11, 45 and 46.

The porting between the pump chamber 16 and the flow-subtraction chamber 41 opens into the flow-subtraction chamber 41 on the front side of the flow-subtraction piston 42. This porting includes a flow-subtraction control orifice 52 and a small vestibule 53. When the piston 42 is seated against the mouth of the porting (against the rim of the vestibule 53 in the illustrated device), the piston 42 is at its minimum-volume position and the flow-subtraction chamber 41 is sealed against inflow of fuel from pump chamber 16. The flow-substraction chamber remains sealed to inflow of fuel from pump chamber 16 until such time as the pressure of the fuel in pump chamber 16 is sufficient to overcome the spring 43. This opening-pressure requirement is relatively high as compared to the relatively lower translating-pressure requirements that apply when the piston 42 starts to lift and the incoming pressurized fuel starts to act on the piston's entire front face. Such lower translating-pressure requirements continue to apply at all intermediate positions of the piston as it moves toward its maximum-volume position. As indicated above, the maximum-volume position is that at which further movement of the piston 42 is stopped. During each pump stroke, subtractive flow through the flow-subtraction control orifice 52 is delayed until the relatively high opening-pressure requirement is met, and thereafter the rate of subtractive flow is governed by the cross-sectional area of the orifice 52; at the same time such area is small enough that, when the piston lifts or opens from its minimum-volume position, pressure upstream of the control orifice drops only slightly so that injection proceeds without interruption. The volume of subtractive flow during each pump stroke is determined by the stroke or displacement distance 47 and of course is equal to that distance multiplied by the transverse cross-sectional area of the piston 42.

In the device as shown in the drawings, the mouth or rim of the vestibule 53 is shown as an edge defined by the intersection between the side wall of the vestibule and the end wall of the flow-subtraction chamber 21. This provides only linear contact between this edge and the shallowly conical face of the flow-subtraction piston 42 when the piston is closed. To provide area contact instead, the rim of the vestibule may be slightly chamfered to provide a shallowly conical surface complementary to that of the face of the piston, so that the rim and piston face contact each other over a narrow band.

In operation, as the plunger 15 moves downward and the plunger helix or edge 23 covers bushing port 21, a pressure wave is generated and travels from the pump chamber 16 past the check valve 28 and to the chamber surrounding the lower end of the nozzle valve 18. The nozzle remains closed until the first or some succeeding pressure wave raises the pressure to the level of the nozzle opening pressure at which time the nozzle valve lifts and injection begins.

The opening-pressure requirement of the flow-subtraction piston 42 may be set to be the same or somewhat higher than the nozzle opening pressure. This opening-pressure is determined by the force of the spring 43 and the area of the face of the piston exposed to vestibule 53. When this opening-pressure requirement is reached, fuel begins to flow through the flow-subtraction control orifice 52, vestibule 53, and into the flow-subtraction chamber 41. If the nozzle opening pressure and the opening-pressure requirement of the flow-subtraction piston are the same, then the nozzle opens and the piston starts its displacement at substantially the same time. If not, the injection pressure continues to rise in the early phases of injection and when it reaches the opening-pressure requirement of the flow-subtraction piston 42, the latter starts its displacement. The force of the spring and the area of exposure of the piston to pressure of incoming fuel, at the closed, minimum-volume position of the piston, are such that the piston starts to lift from its closed, minimum-volume position at or about the same time that the opening pressure of the nozzle is reached.

Piston 42 is moved (displaced) by incoming pressurized fuel from pump chamber 16 from the minimum-volume position illustrated in FIGS. 1 and 2 through intermediate positions to a maximum-volume position at which further movement away from the minimum volume position is stopped, as previously described. The stroke or distance 47 indicated in FIG. 2 is the measure of the displacement from minimum-volume position to maximum-volume position. During this movement, fuel behind the piston is vented or returned to the fuel supply ducting 17 via the passageway including elements 48, 49 and 50.

As just indicated, this subtractive flow through the flow-subtraction control orifice 52 is delayed until the relatively high opening-pressure requirement is met. However, once subtractive flow through the flow-subtraction control orifice 52 starts, the rate of flow through the orifice is limited by the restrictive cross-sectional area of the orifice. This remains true throughout the travel of the piston to its maximum-volume position, the diameter of the piston being sufficiently large and the spring rate of the spring being sufficiently low (taking into account the extent of displacement of the piston between minimum-volume and maximum-volume positions of the piston, and the force exerted by the spring at minimum-volume position of the piston) that resistance to flow is only imposed by the control orifice during said travel, and no significant resistance to flow is imposed by the spring. Proportioning of flow as between (i) flow through the control orifice 52 and (ii) flow through the combined nozzle orifices is determined by the proportion between the cross-sectional area of the control orifice and the combined cross-sectional area of the nozzle orifices, and such proportioning of flow is maintained during the entire reduced-rate-of-injection phase and under various loads and operating speeds of the injector.

To repeat, as the piston opens from its closed, minimum-volume position, pressure tends to momentarily drop in the pump chamber and the nozzle feed due to the creation of the flow path through the control orifice 52, which now supplements the flow paths through which fuel flows to and through the injector nozzle. Importantly, the cross-sectional area of the control orifice 52 is selected to be sufficiently small that such drop in pressure is minimal enough that the nozzle valve remains open and injection proceeds without interruption during the entire injection phase of each cycle of operation of the injector. At the same time, the cross-sectional area of the control orifice 52 is of such size and capacity as to be compatible with the accomplishment of the aforesaid proportioning of flow between it and the combined nozzle orifices. These relationships apply under all loads and operating speeds of the injector.

The volume of subtractive flow during each stroke of the pump plunger 15 is determined by the stroke or displacement distance 47 of the piston 42 and of course is equal to that distance multiplied by the transverse cross-sectional area of the piston 42.

As indicated above, fuel is intended to be diverted through the control orifice 52 to the flow-subtraction chamber 41 during the initial or reduced-rate-of-injection phase of injection, which may correspond to, or slightly exceed in duration, the ignition delay period.

Subject to the above considerations, the cross-sectional area a of the control orifice is determined in terms of other imposed or selected values listed below, as follows:

- Q=engine total fuel quantity per injection at full load ($mm^3$/ injection)
- $Q_r$=reduced-rate-of-injection phase fuel quantity as a fraction of Q (dimensionless number)
- $Q_rQ$=reduced-rate-of-injection phase fuel quantity per injection ($mm^3$/injection)
- $\Theta_m$=duration of main injection phase (degrees)
- $\Theta_r$=duration of reduced-rate-of-injection phase, equal to or slightly greater than ignition delay period (degrees)

$R_r=Q_rQ/\Theta_r$=rate of injection of reduced-rate-of-injection phase ($mm^3$/degree)

$R_m=(Q-Q_rQ)/\Theta_m$=rate of injection, main injection phase ($mm^3$/degree)

$R_s=R_m-R_r$=rate of subtractive flow past control orifice ($mm^3$/degree)

A=combined nozzle orifice area ($mm^2$)

a=flow-subtraction control orifice area ($mm^2$)

$a=(R_s/R_r)A$ ($mm^2$)

The duration, in degrees, of the reduced-rate-of-injection phase with reference to the main injection phase is determined by the stroke 47 of the piston 42 and the size of the control orifice 52. For a specific size control orifice, the longer the stroke 47, the longer is the duration of the reduced-rate-of-injection phase and the greater is the quantity of fuel that is injected during this phase. The desired rate of the reduced-rate-of-injection phase can be obtained by appropriately selecting the size of the control orifice 52 in proportionate relation to the nozzle total orifice area.

A general goal is to reduce the quantity of fuel injected into the engine during the ignition delay period to reduce nitrous oxide emissions and at the same time improve combustion efficiency. The ignition delay period for an open chamber diesel engine operating on No. 1 or No. 2 fuel oil of 40 to 45 cetane varies from 0.50 to 0.88 milliseconds as reported by a number of investigators. Reasons for this wide variation in delay period include differences in engine combustion chamber physical characteristics such as compression ratio, inlet air temperature, and combustion chamber air turbulence, and differences in injection systems regarding injection pressure, nozzle orifice area, number of holes and their diameter and length, etc. For purposes of preliminary calculation of what delay in degrees will apply on average, an average of the reported delay times may be used:

$$(0.00050+0.00088)/2=0.00069 \text{ seconds}$$

The delay period expressed in engine crank degrees for an engine operating at 900 rpm is:

$$((900\times360)/60)\times0.00069=3.73 \text{ degrees}$$

Thus in this average or typical circumstance where the delay time is 0.00069 seconds, the size of the control orifice 52 and the stroke 47 of the piston 42 are made such that the duration of the reduced-rate-of-injection phase equals 3.73 crank degrees under full load and rated speed operating conditions, or continues slightly beyond 3.73 degrees as may be required for emissions and combustion optimization.

As mentioned earlier, the volume of subtractive flow during each stroke of the pump plunger 15 is determined by the stroke or displacement distance 47 of the piston 42 and of course is equal to that distance multiplied by the transverse cross-sectional area of the piston 42. When the piston reaches its maximum-displacement or maximum-volume position, no more fuel can be diverted and all fuel delivered by the plunger 15 flows through the injection orifices in the normal injection manner. When the plunger helix or edge 24 uncovers the bushing port 22 during the injection portion of its stroke, fuel delivery by the plunger ceases. The fuel in chamber 41 remains there until the pump plunger 15 begins its return stroke.

At this time, the pressure in the pump chamber 16 is essentially fuel supply pressure, and the piston 42 is urged back toward its minimum-volume position by the force of the spring 43. Conducive to this return movement of the piston 42 is the fact that pressure behind the piston is also essentially fuel supply pressure which is applied at all times, including during return movement of the piston 42, via the vent passageway provided by the elements 48, 49 and 50. As previously indicated, the minimum cross-section of this passageway is sufficient to avoid throttling or choking of the flow of fuel returning from the fuel supply ducting to the rear side of the piston, thereby allowing the full fuel supply pressure in the fuel supply ducting to be undiminishedly applied below or on the back side of the piston to help return the piston to its closed, minimum-volume position and thereby undiminishedly help return (add back) the subtracted fuel to or toward the pump chamber during the return stroke of the pump.

As the pump plunger continues moving on its return stroke, the spill port 22 is covered by the helix or control edge 24 so that both bushing ports 21 and 22 are closed and a vacuum is produced. This reduces the force that must be overcome by the spring force and the force of the fuel supply pressure acting below or on the back side of the piston 42. The pressure on the back side of the piston continues to be substantially equal to the fuel supply pressure by virtue of the unrestricted communication from the fuel supply ducting 17, as described above. During this time fuel is returned to the injector fuel delivery system through the same orifice 52 through which it entered the chamber 41.

It is important that the piston 42 return to its closed position before the beginning of the next injection cycle. To accomplish this, it is necessary that the force of the spring 43 be sufficient to accelerate the mass of the piston 42 and to force the fuel on the front side of the piston in the storage chamber 41 through the orifice 52 during the return stroke of the pump plunger 15. Fuel pressure behind (below) the piston 42 is no less than the pressure in pump chamber 16 during the whole return stroke of the pump plunger 15. As stated above, when both ports 21 and 22 are closed by the control helices or lands 23 and 24 during the return stroke, there is a vacuum condition above the plunger, and the fuel pressure behind the piston is therefore greater than that in the pump chamber 16 during this part of the return stroke of the pump plunger.

During the reduced-rate-of-injection phase while the piston 42 is moving toward its maximum-volume position, the injection pressure in the system will be lower than it otherwise would be without the reduced initial rate feature because of the increased flow area introduced by the flow-subtraction control orifice 52. It may be found necessary to increase the nozzle opening pressure somewhat to enhance atomization to normal injection quality of the initial burst of injection.

Figure 3:
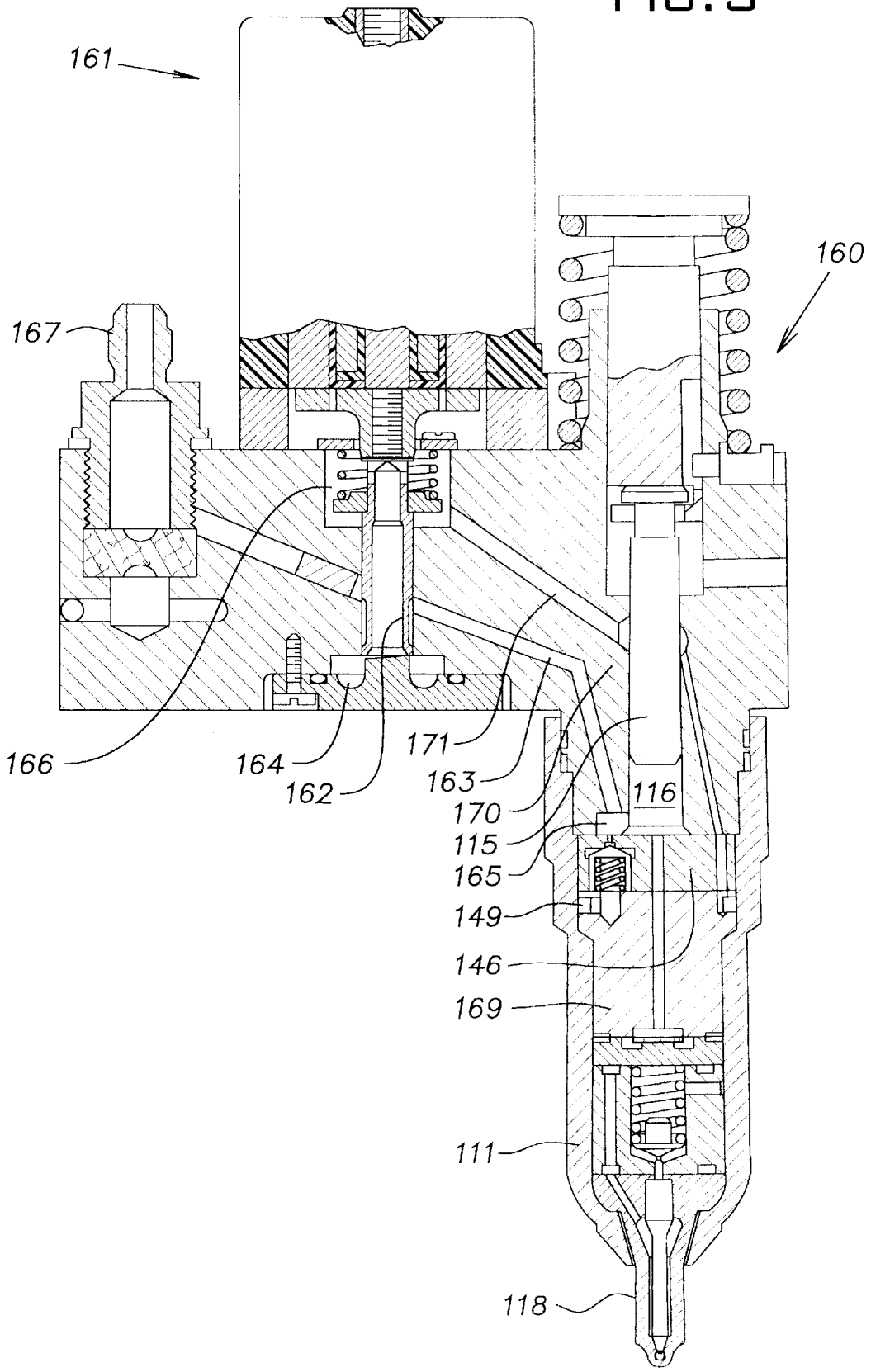
FIG. 3 is a cross-sectional view of a unit injector of the solenoid-controlled type, of a kind manufactured or formerly manufactured by EMD, modified to embody the invention.

The injector 160 seen in FIG. 3 will be recognized by those familiar with the art as a modified unit injector of the solenoid-controlled type manufactured or formerly manufactured by EMD. A typical prior-art EMD unit injector of this type in unmodified form is shown in U.S. Pat. No. 4,392,612.

As is well known, instead of relying on control edges on the pump plunger to control the spill of fuel from the pump chamber during the injection stroke of the piston, this type of injector instead uses a solenoid-controlled valve. Thus the injector shown in FIG. 3 is provided with a solenoid assembly 161 and a normally open solenoid-operated valve 162 which, when closed, blocks egress of fuel from the fuel ingress/egress passage 163 to the spill cavity 164 which in turn is connected to a drain passage fitting (not shown) and then back to the reservoir or fuel tank. The passage 163 is connected to an arcuate chamber 165 which in turn opens into the pump chamber 116. When open, the valve 162 permits fuel to pass from the supply cavity 166 via the spill cavity 164 into the ingress/egress passage 163 and thence to the pump chamber 116. A fuel supply fitting 167 is connected through external lines (not shown) to the external fuel supply system and via internal passages (not shown) to the fuel supply cavity 166.

At the start of the pump stroke of the pump plunger, the solenoid-operated valve 162 is open. To start the injection portion of the feed stroke, the solenoid is energized to close the valve 162, causing pressure to rapidly build up to the opening pressure of the nozzle valve 118, and injection begins. Injection continues until the solenoid is de-energized to open the valve 162, allowing fuel pressure to drop below the closing pressure of the nozzle valve and causing injection to cease. Thus the interval between energizing and de-energizing of the solenoid determines the duration of the injection portion of the pump stroke.

Figure 4:
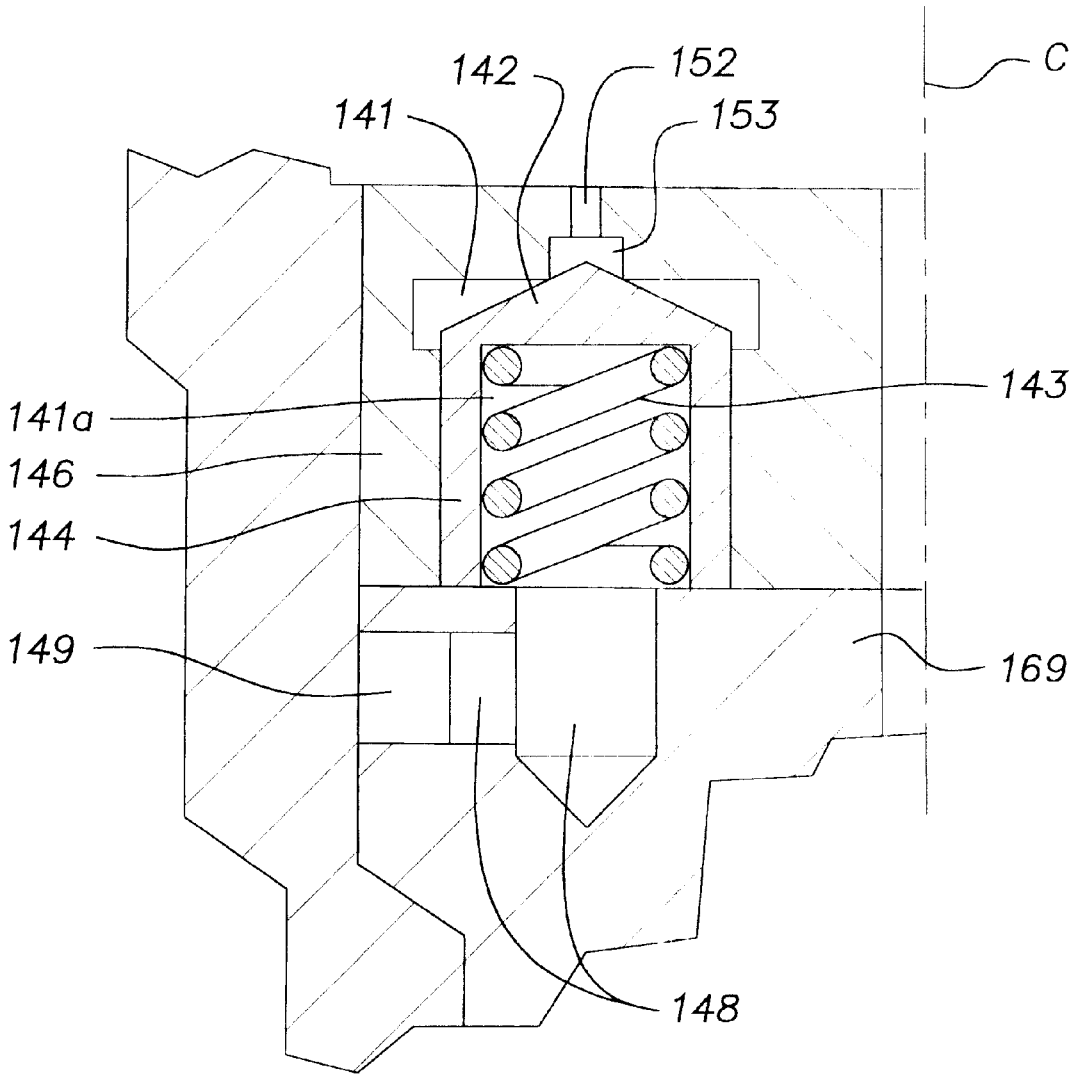
FIG. 4 is a fragmentary view on an enlarged scale of a portion of the structure viewed in FIG. 3. The axis C in FIG. 4 (not labelled in FIG. 3) marks the central axis of the injector nozzle.

According to the present invention, an annular piston housing body 146 may be provided as one of the stacked components within the elongated nut or housing 111, immediately above the cage 169 and below the body 170 which serves as the bushing for the pump plunger and in which the arcuate chamber 165 and pump chamber 116 are formed. As shown in FIG. 4, associated with the body 146 are a variable-volume flow-subtraction chamber or storage chamber 141, spring-loaded flow-subtraction piston 142, spring 143, piston skirt 144, flow-subtraction control orifice 152 and vestibule 153. Associated with the cage 169 are a passageway consisting of drilled holes 148 and an annular groove 149. One of the holes 148 opens to the space 141*a* behind the piston. The annular groove 149 communicates with the fuel drain line 171 through suitable passages as shown in FIG. 3. The cage 169, housing body 146 and body 170 may be pinned against relative rotation to assure proper alignment of passages to maintain this communication.

Operation of this embodiment is similar to that of the embodiment of FIGS. 1 and 2 insofar as the function of providing for injection at a reduced rate in early parts of the injection portion of the stroke by diverting flow to a storage chamber from which the fuel is returned on the return stroke. Such operation should be obvious from the above description of the operation of the embodiment of FIGS. 1 and 2. Except for the substitution of a solenoid instead of control edges on the pump plunger as the means for stopping and then restarting the spilling of fuel during the pump stroke, the operation of the second embodiment in respect of its reduced-rate-of-injection phase feature is essentially the same as that of the embodiment of FIGS. 1 and 2, and the various criteria and relationships mentioned above in connection with latter apply also to the embodiment of FIGS. 3 and 4.

At the beginning of injection, or immediately afterward, the pressure in vestibule 153 has reached the lifting pressure of the displacement or flow-subtraction piston 142 and fuel diversion begins as the piston starts to lift and fuel starts to flow through flow-subtraction control orifice 152 into chamber 141. The piston 142 continues to move as fuel continues to flow through the control orifice 152 until it is stopped at its maximum-volume position. Again, throughout this movement, flow through the control orifice is never significantly limited by the piston spring.

Again, the ratio of the fuel delivered to the piston chamber during the reduced-rate-of-injection phase injection period is based on the ratio of the area of the flow control orifice to the total area of all the injection nozzle orifices. Again, the reduced-rate-of-injection phase may be equal to or slightly greater than the ignition delay period.

During the movement of the piston to its maximum-volume position, fuel behind it is dispelled to the fuel drain line 171 through the connecting passages shown in FIG. 3. After the end of injection during the return stroke of the plunger, fuel is returned to the pump chamber through the orifice 152 and such return is unimpededly assisted by fuel supply pressure in the manner previously described in connection with the embodiment of FIGS. 1 and 2.

Figure 5:
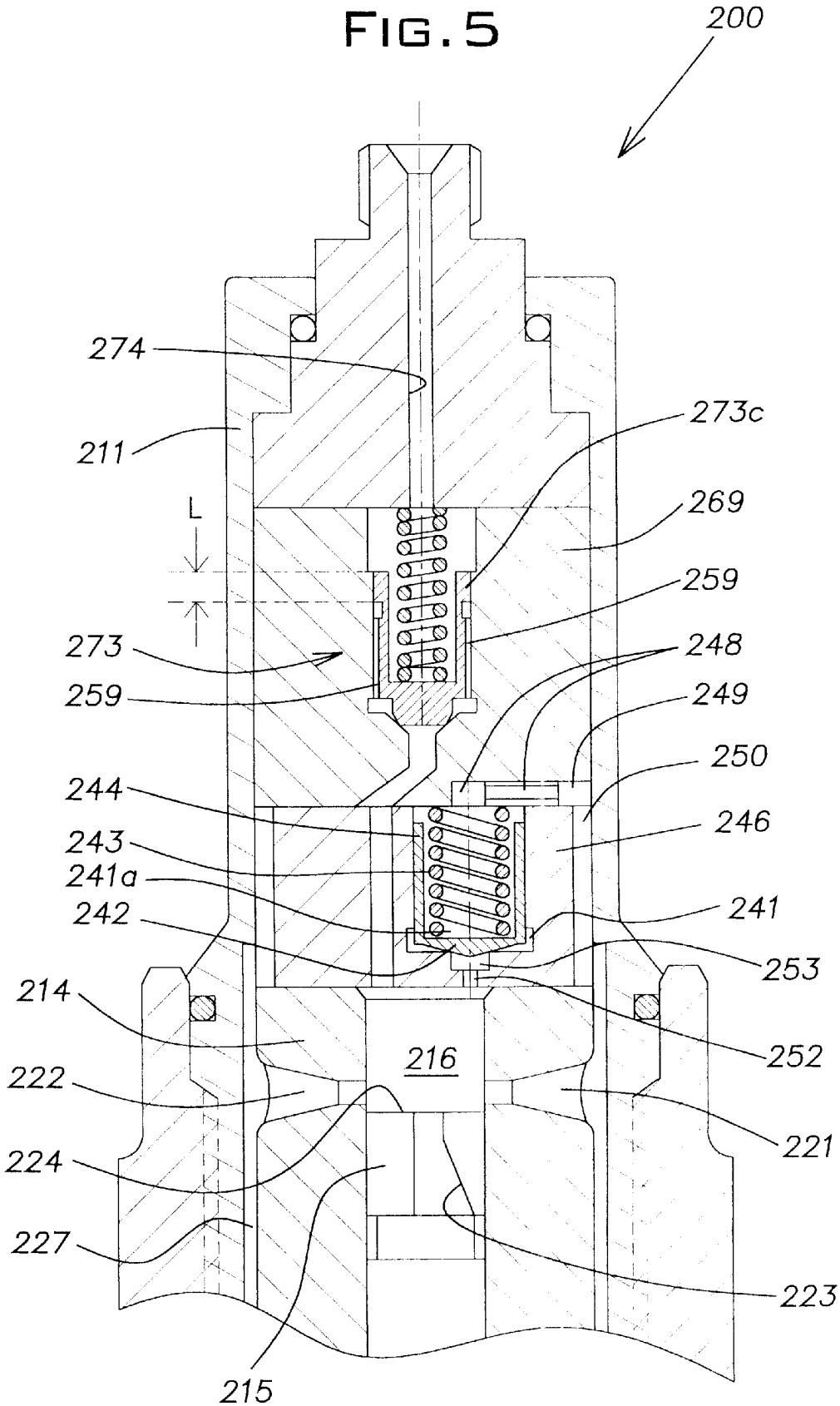
FIG. 5 is a fragmentary cross-sectional view of the pump of a three-piece injection system (pump, tubing, and nozzle and holder assembly) of the mechanically controlled type, of a kind manufactured or formerly manufactured by General Electric, modified to embody the invention by inclusion of the flow-subtraction chamber, flow-subtraction piston and flow-subtraction control orifice within the pump.

The injector pump 200 schematically shown seen in FIG. 5 will be recognized by those familiar with the art as a pump of a three-piece injection system (pump, tubing, and nozzle-and-holder assembly) of the mechanically controlled type. Such pump will be recognized as a kind used on General Electric locomotive engines, but modified therefrom. Such modifications illustrate another embodiment of the present invention.

In this type pump, the spill ports 221 and 222 are closed by the plunger top face or control edge 224 to start the fuel injection phase of the pump stroke, and later the port 221 is opened by the control edge or land 223 to spill the pump chamber 216 and end the fuel injection phase.

According to the present invention, an annular piston housing body 246 may be provided as one of the stacked components within the elongated nut or housing 211, immediately below the delivery valve body 269 and immediately above the pump bushing 214. Associated with the body 246 are a variable-volume flow-subtraction chamber or storage chamber 241, spring-loaded flow-subtraction piston 242, spring 243, piston skirt 244, flow-subtraction control orifice 252 and vestibule 253. Associated with the delivery valve body are a passageway consisting of drilled holes 248 and an annular groove 249. One of the holes 248 opens into the space 241*a* behind the piston. The annular groove 249 may communicate with the fuel supply ducting 227 through slot 250. The delivery valve body 269 and housing body 246 may be pinned against relative rotation to assure proper alignment of passages to maintain associated communications.

The piston 242 is larger in diameter than the piston 42 shown in FIGS. 1 and 2 because of the larger full load fuel requirement for engines with which this particular injection pump is used, requiring in turn a greater diversion quantity during the ignition delay period. Also, the opening pressure of the piston 242 relative to the nozzle opening pressure must be evaluated carefully because of the effect of the connecting tubing length from the pump to the nozzle holder with regard to pressure waves and the time relationship of the levels of pressure occurring at the pump and nozzle. Nevertheless, the opening or beginning of lift pressure of the piston 242 must be at a level that causes the piston 242 to start lifting at the same time or immediately after the nozzle valve lifts initiating beginning of injection. The shorter the tubing length, the easier it is to accomplish this coordination.

Again, the ratio of the fuel delivered to the chamber 241 to that delivered through the injection nozzle orifices is based on the ratio of the area of the flow control orifice to the combined area of the injection nozzle orifices.

Again, operation of this embodiment is similar to that of the embodiment of FIGS. 1 and 2 insofar as the function of providing for injection at a reduced rate in early parts of the injection portion of the stroke by diverting flow to a storage chamber from which the fuel is returned on the return stroke. Operation of the flow-subtraction piston 242 is the same as described for the piston 42 of FIGS. 1 and 2. Fuel flows through the delivery valve 273 in the normal manner past four flats formed in the cylindrical surface of the delivery valve (two of the flats are seen in FIG. 5 and are labelled 259), and on through the duct 274 and connecting tubing (not shown) to the nozzle-and-holder assembly (not shown). Then, as described above in the other embodiments, at the beginning of injection or immediately afterward the pressure in vestibule 253 reaches the lifting pressure of piston 242 and fuel diversion begins by fuel flowing through flow-subtracting control orifice 252 into chamber 241. The force of the spring and the area of exposure of the piston to pressure of incoming fuel, at the closed, minimum-volume position of the piston, are such that the piston starts to lift from its closed, minimum-volume position at or about the same time that the opening pressure of the nozzle is reached.

As this flow into chamber 241 commences, pressure upstream of the control orifice tends to momentarily drop. However, the cross-sectional area of the control orifice is sufficiently small that such drop in pressure is only minimal, so that injection proceeds without interruption during the injection phase in each cycle of operation of the injector. At the same time, such cross-sectional area is compatible with the accomplishment of the proportioning described below.

The piston 242 continues to move as fuel continues to flow through the control orifice 252 until the piston is stopped at its maximum-volume position. The diameter of the piston is sufficiently large and the spring rate of the piston spring is sufficiently low that, once the subtractive flow through the control orifice begins, such flow is never significantly limited by resistance from the spring at any time throughout travel of the piston to its maximum-volume position, and the control orifice therefore determines and maintains the desired predetermined proportioning, as between said injection nozzle orifices and said flow-subtraction control orifice, of flow of pressurized fluid passing from said injection-pressure side of said system prior to said flow-subtraction piston stopping at its said maximum-volume position in each injection cycle, During this movement of the piston, fuel behind it is dispelled to the fuel supply ducting 227. After the end of injection during the return stroke of the plunger, fuel is returned to the pump chamber through the orifice 252 in the same manner as previously described in connection with the embodiment of FIGS. 1 and 2.

The injection pumping section of FIG. 5 may be modified to a structure (not illustrated) in which the fuel-subtraction piston and associated elements are included in the delivery valve assembly so that both the delivery valve and the flow-subtraction piston and its associated elements are located in the delivery valve assembly in side-by-side relationship, and the piston housing body 246 of FIG. 5 may be thereby eliminated. This reduces pump height and allows shortening of the housing or nut 211 of FIG. 5. For the engines on which this type of pump is used, reducing the height of the pump is important. This change also allows simplification of the ducting involved with the performance of the flow-subtraction piston, and reduces the cost of the injection pumping section as compared to the pumping section of FIG. 5.

Figure 6:
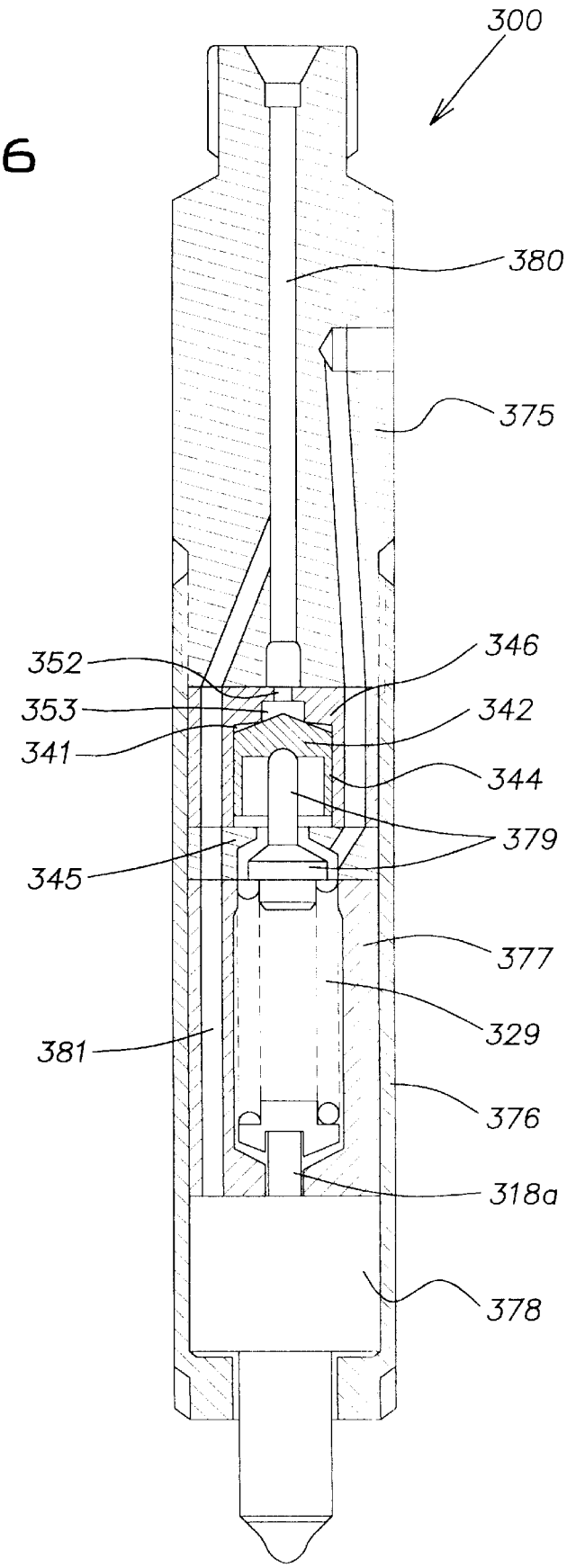
FIG. 6 is a cross-sectional view of the nozzle-and-holder assembly of another three-piece injection system in which the flow-subtraction chamber, flow-subtraction piston and flow-subtraction control orifice are included within the nozzle-and-holder assembly, and the nozzle valve spring also functions as the spring for the flow-subtraction piston.

FIG. 6 shows the invention included in the nozzle-and-holder assembly 300 of a another three-piece injection system comprising a pump (not shown), connecting tubing (not shown), and the nozzle-and-holder assembly). A nozzle holder body 375 receives a nozzle housing nut 376 in which are stacked a piston housing body 346 containing a flow-subtraction piston 342, the annular spacer 345, the housing 377 for the nozzle valve spring 329, and the nozzle valve (the only part of which is visible in the drawing being the top end 318*a* of the valve stem) and nozzle valve housing 378. In this embodiment, the valve spring 329 also acts as the spring for the flow-subtraction piston. To this end, the upper end of the spring 329 engages the spring-seat member 379 which in turn engages the piston 342.

The device as so far described is similar to the device described in K. P. Mayer's SAE paper 841288 previously mentioned; however according to the present invention the device also includes the flow-subtraction control orifice 352 leading into the vestibule 353 above the variable-volume flow-subtraction chamber 341. As in the previous embodiments, the control orifice is sized to establish the desired proportion between its area and the total or combined nozzle orifice area and, in each cycle of operation, flows through the respective areas are maintained in that same proportion throughout the injection phase, and at medium and high engine speeds and loads, the area of the control orifice being sufficiently small that, as the piston lifts from its closed minimum-volume position, pressure upstream of the control orifice and in the passage 380 leading from the pump (not shown) via the connecting tubing (not shown) drops only minimally so that injection proceeds without interruption during the injection phase of each cycle of operation of the injector. While sufficiently small to prevent such interruption, the area of the control orifice is compatible with the accomplishment of the aforesaid proportioning of flow between it and the combined nozzle orifices.

As in the other embodiments of the invention described above, the diameter of the piston is sufficiently large and the spring rate of the spring engaging the piston is sufficiently low that at all times during movement of the piston to its maximum-volume position (defined by the stop provided by engagement of the piston skirt 344 with the top face of the annular spacer 345), the rate of subtractive flow through the control orifice is not substantially limited or controlled by resistance from the spring, and the aforesaid proportion between flows through the control orifice and the combined nozzle orifice area is maintained.

Also, again in this embodiment, the force of the spring and the area of exposure of the piston to pressure of incoming fuel, at the closed, minimum-volume position of the piston, are such that the piston starts to lift from its closed, minimum-volume position at or about the same time that the opening pressure of the nozzle is reached.

In this embodiment, when fuel delivery by the pump ends, a negative pressure wave travels to the nozzle. The pressure drops in a normal manner to below the nozzle closing pressure. The spring force on the nozzle valve is greater than when the nozzle is open by virtue of the spring being compressed an additional amount by the lifting of the subtraction piston. Not only does the nozzle valve close faster because of the higher spring force, but the fuel in the storage chamber is ready to start flowing back into the high pressure system because the pressure therein is lower than the nozzle closing pressure at this time, and spring force is more than adequate to start seating the piston. Also, shortly after the nozzle closes the pressure waves caused by the cut-off of fuel delivery by the pump and by the retraction action of the delivery valve through its sweep volume (the product of (i) the transverse cross sectional area of the collar 273*c* and (ii) the length L at the illustrated fully closed position of the delivery valve) subside and the pressure in the system stabilizes to a residual level far below the nozzle closing pressure. Because the residual pressure is so far below the nozzle closing pressure, the spring force on the piston is more than adequate to drive the piston to its seat before the start of the next injection cycle.

All the injection systems described above have an injection-pressure side and a fuel supply/drain side. The injection-pressure side includes those fuel-containing parts of the system that become pressurized far above supply pressure when all spill ports are closed during the injection stroke of the pump plunger. The fuel supply/drain side includes those fuel-containing parts of the system that do not become pressurized when all spill ports are closed during the injection stroke. For example, in the two embodiments of FIG. 1–4, the pump chambers 16 and 116 and the various passages leading from the respective pump chambers to the respective injection nozzles are included in the injection-pressure sides of the systems. In the embodiment of FIG. 5, the injection-pressure side of the system similarly includes the pump chamber 216 and the various passages and lines leading directly or indirectly from the pump chamber to the injection nozzle (not shown), as well as the delivery valve 273. In the embodiment of FIG. 6, the injection-pressure side of the system includes the pump (not shown) and connecting tubing (not shown) leading to the illustrated nozzle-and-holder assembly, and also includes the passages 380 and 381, and the nozzle chamber and sac (not shown) fed from the passage 381. Thus, in the several embodiments described, the control orifices 52, 152, 252 and 352 each will be understood to be ported to the injection-pressure side of its associated system. In the first three embodiments, the control orifices 52, 152 and 252 are ported to their respective pump chambers 16, 116, and 216. In the fourth embodiment (FIG. 6), the control orifice 352 is ported to a part of the injection-pressure side of the system that is downstream of the pump chamber (not shown), namely the passage 380.

The foregoing improvements offer a practical means to substantially reduce nitrous oxide emissions and improve combustion by modifications of diesel fuel injection systems. It should be evident that this disclosure is by way of example, and that various changes may be made by adding, modifying or eliminating features without departing from the fair scope of the teachings contained in this disclosure. The invention is therefore not limited to particular details of this disclosure except to the extent that the claims are necessarily so limited.

What is claimed is:

1. In a diesel injection system, a pump and a pump chamber, said pump pressurizing fuel in the pump chamber on each injection cycle, an injection nozzle and an associated nozzle valve, said valve having a given opening pressure and a given lower closing pressure, said injection nozzle having nozzle orifices, said injection system having an injection-pressure side and a fuel supply/drain side, a variable-volume flow-subtraction chamber ported to said injection-pressure side of said system, a flow-subtraction piston loaded by a spring, said piston being slidably associated with said flow-subtraction chamber and, against the bias of said spring, being liftable, by pressurized fuel coming from said injection-pressure side of said system, from a closed, minimum-volume position through intermediate positions to a maximum-volume position at which further movement away from said minimum-volume position is stopped, a flow-subtraction control orifice between said injection-pressure side of said system and said flow-subtraction chamber, said control orifice maintaining, as between flow through said injection nozzle orifices and flow through said flow-subtraction control orifice, predetermined proportioning of flow of pressurized fluid passing from said injection-pressure side of said system prior to said flow-subtraction piston stopping at its said maximum-volume position in each injection cycle, said proportioning being the same as the proportion between the combined cross-sectional area of said nozzle orifices and the cross sectional area of said control orifice, said closed, minimum-volume position of said flow-subtraction piston being characterized by a relatively high opening-pressure requirement whereby during each feed stroke of the pump subtractive flow through said flow-subtraction orifice is delayed until said relatively high opening-pressure requirement is met and said piston lifts from its closed, minimum-volume position, the force of said spring and the area of exposure of said piston to pressure of incoming fuel, at said minimum-volume position of said flow-subtraction piston, being such that said piston starts to lift from its said closed, minimum-volume position at or about the time said given opening pressure of said nozzle valve is reached, said intermediate positions of said flow-subtraction piston being open positions characterized by relatively lower translating-pressure requirements such that, after said opening-pressure requirement is met, then, throughout the travel of said piston to its said maximum-volume position, the rate of subtractive flow is limited by the cross-sectional area of said flow-subtraction control orifice such as to accomplish the aforesaid proportioning, the spring rate of said spring being sufficiently low and the diameter of said piston sufficiently large that, once subtractive flow commences through said flow-subtraction control orifice, said flow is never significantly limited by resistance from said spring at any time throughout travel of said piston to its said maximum-volume position, said flow-subtraction piston being loaded by said spring toward said minimum-volume position to return thereto upon reduction of pressure in said injection-pressure side of said system after injection terminates in each cycle, the cross-sectional area of said flow-subtraction control orifice being both compatible with the accomplishment of the aforesaid proportioning and sufficiently small that, as such piston lifts from said closed, minimum-volume position, pressure upstream of said orifice drops only minimally so that injection proceeds without interruption during the injection phase of each cycle of operation of said injector at various loads and operating speeds.

2. In the diesel injection system of claim 1, said flow-subtraction chamber being ported through said control orifice directly to said pump chamber.

3. In the diesel injection system of claim 1, said flow-subtraction chamber being ported through said control orifice to a part of said injection-pressure side of said system downstream of said pump chamber.

4. In the diesel injection system of claim 1, said system having fuel supply ducting for supplying fuel at relatively low supply pressure to said pump chamber and for receiving fuel leaked from higher pressure parts of the system, a passageway connected to said fuel supply ducting and opening into space behind said flow-subtraction piston whereby fuel behind said piston may leak to said fuel supply ducting as said piston advances toward its said maximum-volume position, the minimum cross-sectional area of said passageway being sufficient to allow fuel supply pressure to aid in said return of said piston to said minimum-volume position.

5. In the diesel injection system of claim 1, said relatively high opening-pressure associated with said seated position of said flow-subtraction piston being equal or greater than said opening pressure of said nozzle valve.

6. In the diesel injection system of claim 1, said relatively high opening-pressure associated with said seated position of said flow-subtraction piston being greater than said opening pressure of said nozzle valve.

7. In the diesel injection system of claim 1, said relatively high opening-pressure associated with said seated position of said flow-subtraction piston being such that said subtractive flow commences substantially simultaneously with commencement of flow through said nozzle orifices.

8. In the diesel injection system of claim 1, said relatively high opening-pressure associated with said seated position of said flow-subtraction piston being such that said subtractive flow commences shortly after commencement of flow through said nozzle orifices.

9. A diesel injector comprising, a pump and a pump chamber, said pump pressurizing fuel in the pump chamber on each injection cycle, an injection nozzle and an associated nozzle valve, said valve having a given opening pressure and a given lower closing pressure, said injection nozzle having nozzle orifices, said injection system having an injection-pressure side and a fuel supply/drain side, a variable-volume flow-subtraction chamber ported to said injection-pressure side of said system, a flow-subtraction piston loaded by a spring, said piston being slidably associated with said flow-subtraction chamber and, against the bias of said spring, being liftable, by pressurized fuel coming from said injection-pressure side of said system, from a closed, minimum-volume position through intermediate positions to a maximum-volume position at which further movement away from said minimum-volume position is stopped, a flow-subtraction control orifice between said injection-pressure side of said system and said flow-subtraction chamber, said control orifice, during each feed stroke of the pump, maintaining, as between flow through said control orifice and flow through said injection nozzle orifices, predetermined proportioning of flow of pressurized fluid passing from said injection-pressure side of said system during the interval in which there simultaneously is occurring both (i) flow through said control orifice prior to the stopping of said flow-subtraction piston at its said maximum-volume position and (ii) flow through said injection nozzle orifices, said proportioning being the same as the proportion between the combined cross-sectional area of said nozzle orifices and the cross sectional area of said control orifice, said closed, minimum-volume position of said flow-subtraction piston being characterized by a relatively high opening-pressure requirement whereby during each feed stroke of the pump subtractive flow through said flow-subtraction orifice is delayed until said relatively high opening-pressure requirement is met and said piston lifts from its closed, minimum-volume position, said intermediate positions of said flow-subtraction piston being open positions characterized by relatively lower translating-pressure requirements such that, after said opening-pressure requirement is met, then, throughout the travel of said piston to its said maximum-volume position, the rate of subtractive flow is limited substantially solely by the cross-sectional area of said control orifice, and not by said translating pressure requirements.

10. A device as in claim 9, the spring rate of said spring being sufficiently low and the diameter of said piston sufficiently large that, once subtractive flow commences through said flow-subtraction control orifice, said flow is never significantly limited by resistance from said spring at any time throughout travel of said piston to its said maximum-volume position.

11. In the injector device of claim 9, the cross-sectional area of said flow subtraction control orifice being both compatible with the accomplishment of the aforesaid proportioning and sufficiently small that, as said piston lifts from said closed, minimum-volume position, pressure upstream of said orifice drops only minimally so that injection proceeds without interruption during the injection phase of each cycle of operation of said injector at various loads and operating speeds.

12. In the diesel injector device of claim 9, said device having fuel supply ducting for supplying fuel at relatively low supply pressure to said pump chamber and for receiving fuel leaked from higher pressure parts of the system, a passageway connected to said fuel supply ducting and opening into space behind said flow-subtraction piston, whereby fuel behind said piston may leak to said fuel supply ducting as said piston advances toward its said maximum-volume position, the minimum cross-sectional area of said passageway being sufficient to allow fuel supply pressure to aid in said return of said piston to said minimum-volume position.

* * * * *

UNITED STATES PATENT AND TRADEMARK OFFICE

CERTIFICATE OF CORRECTION

PATENT NO. : 6,360,727 B1
DATED : March 26, 2002
INVENTOR(S) : DeLuca

It is certified that error appears in the above-identified patent and that said Letters Patent is hereby corrected as shown below:

Title page, Item [54], and Column 1, line 1,
Please delete "REDUCE" and insert therefor -- REDUCED --.

Column 3,
Lines 9, 17, 20, 21 and 23, please delete "m" and insert therefor -- m --.
Lines 17 and 19, please delete "n" and insert therefor -- n --.
Line 19, please delete "g" and insert therefor -- g --.
Lines 20 and 26, please delete "k" and insert therefor -- k --.
Line 23, please delete "c" and insert therefor -- c --.
Line 24, please delete "e" and insert therefor -- e --.
Line 25, please delete "i" and insert therefor -- i --.
Line 48, please delete "as" and insert therefor -- as --.

Column 5,
Line 33, please delete "type' in" and insert therefor -- type in --.

Column 8,
Line 56, please delete "a" and insert therefor -- a --.

Signed and Sealed this

Twenty-third Day of July, 2002

*Attest:*

*Attesting Officer*

JAMES E. ROGAN
*Director of the United States Patent and Trademark Office*